US006383703B1

(12) United States Patent
Asano et al.

(10) Patent No.: US 6,383,703 B1
(45) Date of Patent: May 7, 2002

(54) NON-MAGNETIC MONO-COMPONENT TONER

(75) Inventors: Shigetoshi Asano; Morito Takamuro, both of Okayama (JP)

(73) Assignee: Imex Co., Ltd., Kanagawa (JP)

( * ) Notice: Subject to any disclaimer, the term of this patent is extended or adjusted under 35 U.S.C. 154(b) by 0 days.

(21) Appl. No.: 09/774,711

(22) Filed: Feb. 1, 2001

(30) Foreign Application Priority Data

Oct. 2, 2000 (JP) ..... 2000-302049

(51) Int. Cl.[7] ..... G03G 9/097
(52) U.S. Cl. ..... 430/108.1
(58) Field of Search ..... 430/108.1, 108.4, 430/108.6

(56) References Cited

U.S. PATENT DOCUMENTS 6,025,107 A * 2/2000 Sekiguchi et al. ..... 430/110
6,171,743 B1 * 1/2001 Nakamura ..... 430/110

* cited by examiner

*Primary Examiner*—John Goodrow
(74) *Attorney, Agent, or Firm*—Young & Thompson

(57) ABSTRACT

A non-magnetic mono-component toner includes a toner and barium titanate having a surface area of 0.5 to 3 $m^2/g$ as measured in accordance with a BET method in an amount of 0.2 to 5 parts by weight per 100 parts by weight of the toner. The toner can form images of a high density and suppress fog in the background simultaneously.

3 Claims, No Drawings

NON-MAGNETIC MONO-COMPONENT TONER

BACKGROUND OF THE INVENTION

1. Field of the Invention

The present invention relates to a non-magnetic mono-component toner and, more particularly, to a toner which can form images of a high density and suppress fog in the background simultaneously.

2. Description of Related Art

To form images of a high density and suppress fog in the background simultaneously, it is necessary that a toner be effectively charged with electricity by the friction of the toner with doctor blades and sleeves. To achieve this condition, it has been attempted that the type and the amount of charge controlling agents are suitably selected and fluidity of the toner is improved by addition of fine silica particles or the like. However, when the amount of the toner is increased to achieve a high density of images, the toner tends to be scattered and fog tends to be formed in the background. It is very difficult that images of a high density are formed and fog in the background is suppressed simultaneously. Therefore, a toner which can form images of a high density and suppress fog in the background simultaneously has been desired.

SUMMARY OF THE INVENTION

The present invention has an object of providing a toner which can form images of a high density and suppress fog in the background simultaneously.

As the result of extensive studies by the present inventors to overcome the above problem, it was found that the property for charging by friction and fluidity of a toner is improved by adding barium titanate having a surface area of 0.5 to 5 $m^2/g$ as measured in accordance with the BET method in an amount of 0.2 to 5 parts by weight per 100 parts by weight of the toner and formation of images of a high density and suppression of fog in the background can be achieved simultaneously. The present invention has been completed based on the knowledge.

The present invention provides:

(1) A non-magnetic mono-component toner which comprises a toner and barium titanate having a surface area of 0.5 to 5 $m^2/g$ as measured in accordance with a BET method in an amount of 0.2 to 5 parts by weight per 100 parts by weight of the toner; and (2) A non-magnetic mono-component toner according to Claim 1, wherein the barium titanate is formed in accordance with a liquid phase process.

DESCRIPTION OF THE PREFERRED EMBODIMENTS

The non-magnetic mono-component toner comprises a toner and barium titanate having a surface area of 0.5 to 5 $m^2/g$ as measured in accordance with the BET method in an amount of 0.2 to 5 parts by weight per 100 parts by weight of the toner.

The toner used in the present invention is not particularly limited. For example, the toner can be prepared by melting and mixing thermoplastic resins, pigments, charge controlling agents and lubricating agents and pulverizing and classifying the obtained mixture. Examples of the thermoplastic resin include polystyrene, styrene-acrylic ester copolymers, polyesters, polyvinylbutyral, epoxy resins, polyamide resins, polyethylene and ethylene-vinyl acetate copolymers. Examples of the pigment include carbon black for black-and-white toners and pigments of cyan, magenta and yellow for color toners. Examples of the charge controlling agent include metal complexes of monoazo dyes, metal complexes of salicylic acid and nigrosine. Examples of the lubricant include hydrocarbons such as paraffin wax, low molecular weight polyethylene and low molecular weight polypropylene; metal soaps such as calcium stearate and zinc stearate; amides of fatty acids such as stearylamide and ethylenebisstearylamide; and esters of fatty acids such as butyl stearate, cetyl palmitate and monostearin. It is preferable that the toner used in the present invention has a volume-average diameter of particles of 5 to 15 $\mu$m and more preferably 8 to 10 $\mu$m.

The non-magnetic mono-component toner comprises barium titanate in an amount of 0.2 to 5 parts by weight per 100 parts by weight of the toner. The barium titanate used in the present invention has a surface area of 0.5 to 5 $m^2/g$ and preferably 1.5 to 3 $m^2/g$ as measured in accordance with the BET method. To obtain the surface area of barium titanate, the adsorption isotherm of a gas is obtained at a temperature around the boiling point and the surface area is calculated based on the assumption that the adsorbed molecules have a spherical shape and the same radius as that of the liquid at the adsorption temperature and form a unimolecular layer on the surface in the two-dimensional closest packing. The adsorbed gas is not particularly limited and, for example, nitrogen or argon can be used. For the measurement in accordance with the BET method, for example, a fully automatic apparatus for the measurement of the surface area distributed by FISONS Company can be used. When the surface area of barium titanate is smaller than 0.5 $m^2/g$ or exceeds 5 $m^2/g$, there is the possibility that the effect of forming images of a high density and suppressing fog in the background simultaneously is not sufficiently exhibited.

The non-magnetic mono-component toner of the present invention comprises barium titanate in an amount of 0.2 to 5 parts by weight, preferably 0.5 to 4 parts by weight and more preferably 1 to 3 parts by weight per 100 parts by weight of the toner. When the amount of barium titanate is smaller than 0.2 parts by weight, there is the possibility that the effect of forming images of a high density and suppressing fog in the background simultaneously is not sufficiently exhibited. The effect of forming images of a high density and suppressing fog in the background simultaneously is exhibited sufficiently by using barium titanate in an amount not exceeding 5 parts by weight per 100 parts by weight of the toner. Therefore, in general, it is not necessary that barium titanate is added in an amount exceeding 5 parts by weight per 100 parts by weight of the toner.

Barium titanate can be formed in accordance with the liquid process or the pulverization process. It is preferable that barium titanate used in the present invention is formed in accordance with the liquid process. Since barium titanate formed in accordance with the liquid process has particles having a spherical shape and a uniform distribution of the particle diameter and contains aggregates only in a small amount, particles of barium titanate are placed between toner particles in an excellently dispersed condition and the excellent effects of forming images of a high density and suppressing fog in the background simultaneously is exhibited.

The non-magnetic mono-component toner of the present invention may further comprise hydrophobic silica in addition to barium titanate. Stability of the toner can be improved by the addition of hydrophobic silica.

Since the non-magnetic mono-component toner of the present invention comprises barium titanate having a surface area of 0.5 to 5 $m^2/g$ as measured in accordance with the BET method, particles of barium titanate are placed between toner particles so that the toner particles are well separated into individual particles and efficiently charged with electricity by friction between the blades and the sleeves. It is considered that the non-magnetic mono-component toner of the present invention exhibits the excellent effect of forming images of a high density and suppressing fog in the background simultaneously due to the above reason. Moreover, filming of the toner on a photosensitive material and attachment of the toner to charged rollers and blades are suppressed by using the non-magnetic mono-component toner of the present invention.

To summarize the advantages of the present invention, the toner can form images of a high density and suppress fog in the background simultaneously.

EXAMPLES

The present invention will be described more specifically with reference to examples in the following. However, the present invention is not limited to the examples.

Example 1

A styrene-butyl acrylate copolymer (the ratio by weight of styrene to butyl acrylate: 80/20) in an amount of 100 parts by weight, 5 parts by weight of carbon black, 2 parts by weight of a monoazo dye containing chromium and 2 parts by weight of a low molecular weight polypropylene were mixed for 10 minutes by a Henschel mixer and then kneaded by a twin-screw extruder having a cylinder temperature set at 150° C. The obtained mixture was cooled and pulverized by a fine pulverizer of the air jet type. The pulverized mixture was classified and a toner having a volume-average particle diameter of 9 $\mu$m was obtained.

To 100 parts by weight of the toner obtained above, 2 parts by weight of barium titanate which was formed in accordance with the liquid process and had a surface area of 1.8 $m^2/g$ as measured in accordance with the BET method and 0.5 parts by weight of hydrophobic silica were added. The mixture was mixed by a Henschel mixer for 5 minutes and a non-magnetic mono-component toner was prepared.

Using the non-magnetic mono-component toner prepared above, test patterns were printed by a laser printer (manufactured by SEIKO-EPSON Co., Ltd., LP9200). After 1,000 test patterns were printed, the 1,000th test pattern was used for the evaluation. The density of the image was as measured by a MACBETH densitometer (manufactured by MACBETH Co., Ltd.) and the fog in the background was as measured by a calorimeter (manufactured by MINOLTA Co., Ltd.). The density of the image was 1.45 and the fog in the background was 0.3%.

Comparative Example 1

A non-magnetic mono-component toner was prepared and evaluated in accordance with the same procedures as those conducted in Example 1 except that strontium titanate having a surface area of 1.0 $m^2/g$ as measured in accordance with the BET method was used in place of barium titanate formed in accordance with the liquid process. The density of the image was 1.20 and the fog in the background was 3%.

Comparative Example 2

A non-magnetic mono-component toner was prepared and evaluated in accordance with the same procedures as those conducted in Example 1 except that 2.5 parts by weight of hydrophobic silica was added in place of 2 parts by weight of barium titanate formed in accordance with the liquid process and 0.5 parts by weight of hydrophobic silica. The density of the image was 1.35 and the fog in the background was 5%.

The results in Example 1 and Comparative Examples 1 and 2 are shown in Table 1.

TABLE 1

| | Added component | Density of image | Fog in background |
|---|---|---|---|
| Example 1 | barium titanate (liquid process) 2 parts by weight<br>hydrophobic silica 0.5 parts by weight | 1.45 | 0.3 |
| Comparative Example 1 | strontium titanate 2 parts by weight<br>hydrophobic silica 0.5 parts by weight | 1.20 | 3 |
| Comparative Example 2 | hydrophobic silica 2.5 parts by weight | 1.35 | 5 |

As shown in Table 1, the non-magnetic mono-component toner of Example 1 which contained barium titanate formed in accordance with the liquid process formed the image having a high density and suppressed the fog in the background simultaneously. In contrast, the non-magnetic mono-component toner of Comparative Example 1 which contained strontium titanate, which is another alkaline earth metal salt of titanic acid, and the non-magnetic mono-component toner of Comparative Example 1 which contained hydrophobic silica alone and did not contain barium titanate formed in accordance with the liquid process gave lower densities of the image and greater fogs in the background than the non-magnetic mono-component toner of Example 1 did.

What is claimed is:

1. A non-magnetic mono-component toner which comprises a toner and spherical barium titanate particles having a surface area of 0.5 to less than 3 $m^2/g$ as measured in accordance with a BET method in an amount of 0.2 to 5 parts by weight per 100 parts by weight of the toner.

2. A non-magnetic mono-component toner according to claim 1, wherein the barium titanate is formed in accordance with a liquid phase process.

3. The toner of claim 1, wherein the surface area is 0.5 to 1.8 $m^2/g$.

* * * * *